US006256802B1

(12) United States Patent
Stradinger

(10) Patent No.: US 6,256,802 B1
(45) Date of Patent: Jul. 10, 2001

(54) APPARATUS FOR INJECTING A REAGENT INTO A STREAM OF RINSE FLUID

(75) Inventor: Jay D. Stradinger, Roscoe, IL (US)

(73) Assignee: Evac International OY, Helsinki (FI)

( * ) Notice: Subject to any disclaimer, the term of this patent is extended or adjusted under 35 U.S.C. 154(b) by 0 days.

(21) Appl. No.: 09/531,791

(22) Filed: Mar. 21, 2000

(51) Int. Cl.[7] ..... E03D 11/00; E03D 9/02

(52) U.S. Cl. ..... 4/432; 222/133; 417/440; 4/224; 137/565

(58) Field of Search ..... 4/432, 224, 222, 4/222.1, 223, 225.1, 226.1, 320, 321, 431–433; 222/133; 417/440; 137/565

(56) References Cited

U.S. PATENT DOCUMENTS

| | | | |
|---|---|---|---|
| 4,156,297 | 5/1979 | Pilolla | 4/320 |
| 4,713,847 | 12/1987 | Oldfelt et al. | 4/316 |
| 4,811,754 | 3/1989 | Wilhelm | 137/218 |
| 4,841,578 | 6/1989 | Mercer | 4/224 |
| 5,245,711 | 9/1993 | Oldfelt et al. | 4/435 |
| 5,692,250 | 12/1997 | Oldfelt et al. | 4/432 |
| B1 4,713,847 | 5/1996 | Oldfelt et al. | 4/316 |

*Primary Examiner*—Gregory L. Huson
*Assistant Examiner*—David Deal
(74) *Attorney, Agent, or Firm*—Marshall, O'Toole, Gerstein, Murray & Borun

(57) ABSTRACT

Apparatus for injecting a reagent into a stream of pressurized rinse fluid delivered to a vacuum toilet. The apparatus is pressure-operated in response to the flow of pressurized rinse fluid, thereby eliminating the need for electric outlets or controls. The apparatus includes an orifice located in a main conduit upstream of a reagent discharge outlet. The orifice reduces the pressure of the rinse fluid thereby to unload a check valve which controls injection of the reagent into the rinse fluid stream. In addition, the volume of a pump chamber for holding reagent is reduced to ensure that the pump maintains its prime. Furthermore, the piping leading into the pump chamber has a relatively uniform inside surface and a tapered insert is used to reduced the cross-sectional area of the reagent extreme, thereby directing air bubbles through the pump chamber.

29 Claims, 2 Drawing Sheets

APPARATUS FOR INJECTING A REAGENT INTO A STREAM OF RINSE FLUID

FIELD OF THE INVENTION

The present invention generally relates to vacuum toilets, and more particularly to rinse fluid systems used in vacuum toilets.

BACKGROUND OF THE INVENTION

Vacuum toilets having rinse fluid systems are generally known in the art. Such vacuum toilets generally include a bowl having an outlet connected by a discharge pipe to a vacuum source, which generates a vacuum level in the discharge pipe. A discharge valve disposed between the toilet outlet and the discharge pipe controls when vacuum is present in the toilet bowl. When the valve is open, a pressure differential created by the vacuum at the bowl outlet and atmospheric pressure inside the toilet bowl pushes material present in the bowl into the discharge pipe.

It is common for such vacuum toilets to provide a rinse fluid system which rinses the surface of the bowl while the discharge valve is open. The rinse fluid systems typically include a spray ring which extends around the rim of the toilet bowl and is formed with nozzles. The nozzles are positioned so that the entire inside surface of the bowl is rinsed when the spray ring is connected to a source of rinse fluid. A problem associated with such rinse fluid systems is the build-up of deposits in the nozzles. Certain materials, such as calcium carbonate, are dissolved in the rinse water. When rinse water remains in the nozzle, it eventually evaporates, leaving a calcium carbonate residue in the toilet bowl and the nozzles. Consequently, the surface of the toilet bowl may become roughened thereby reducing the efficiency with which waste is removed during the flushing operation. In addition, the residue may clog the nozzles, thereby causing incomplete rinsing of the toilet bowl.

In many vacuum toilet system applications, very little rinse fluid is used with each flush, and a very large volume of air passes through the system during each flush. As a result, a hard plaque may build up on the internal surfaces of the discharge pipe and holding tank. While the plaque may be removed using acid, it may not be safe to do so in certain applications, such as vacuum toilets used on aircraft.

It is further known to introduce a chemical reagent into the rinse fluid of a conventional flush toilet for sanitizing the toilet bowl at each flush. This may be done by hanging a cake of water-soluble material in the toilet tank. However, to the best of applicants' knowledge, a similar technique has never been applied to vacuum toilet systems, due to the need for an electric pump to introduce the chemical reagent into the rinse fluid. The need for an additional electrical outlet is a particular disadvantage with respect to retrofit applications such as on aircraft. Further, the electric pump would require controls, which would also require modification of the flush control unit of the vacuum toilet.

Commonly owned U.S. Pat. No. 5,692,250 to Oldfelt et al. discloses a vacuum toilet system in which a chemical reagent is introduced into a rinse water supply during each flush. The system uses a pressure-actuated pump which operates in response to the presence of pressurized rinse fluid, thereby to inject chemical reagent into the stream of rinse of fluid. As a result, the puLnp does not require additional electrical outlets or control lines.

While this system generally addresses many of the problems outlined above, applicants have found this system difficult to implement. More specifically, applicants have found that the check valves used to introduce the chemical reagent into the rinse fluid stream are susceptible to collapse under the pressure of the rinse fluid, thereby rendering reagent injection difficult. In addition, the chemical injection pump is susceptible to losing its prime due to the collection to air bubbles both in a pump chamber and upstream of the check valves. As described in the '250 patent, the pump includes a dual-headed piston disposed inside a housing. When the piston moves in a first direction, it draws reagent into a small diameter portion of the housing. When the piston moves in a second direction, the reagent in the small diameter portion is ejected into the rinse fluid stream. Air bubbles entrapped in the reagent may be drawn toward the chemical pump during operation. The air bubbles may aggregate at irregular surfaces in the reagent supply pipe, such as at shoulders, ledges, and corners, to form an air pocket which causes hydraulic lock of the reagent. In addition, air bubbles passing through the first check valve may collect in the pump chamber to form another air pocket. The air pocket inside the pump chamber may be so large that it is not purged through the second check valve with a single stroke of the pump, thereby causing the pump to lose its prime.

SUMMARY OF THE INVENTION

In accordance with certain aspects of the present invention, an apparatus is provided for injecting a reagent from a reagent supply into a stream of pressurized rinse fluid from a rinse fluid supply. The apparatus comprises a main conduit having an inlet adapted for fluid communication with the rinse fluid supply and an outlet. A reagent conduit has an inlet adapted for fluid communication with the reagent supply and an outlet in fluid communication with a downstream point of the main conduit. A first valve is positioned in an upstream portion of the reagent conduit and a second valve is positioned in a downstream portion of the reagent conduit, the first and second valves defining a pump chamber portion of the reagent conduit therebetween. A pressure actuated pump is provided having an actuating end in fluid communication with the rinse fluid supply and a pumping end in fluid communication with the pump chamber portion. The pressure actuated pump is biased toward a first position in which the reagent is drawn through the first valve and into the pump chamber portion from the reagent supply, and is movable to a second position in response to an actuating force generated by the pressurized rinse fluid contacting the actuating end, in which the reagent in the pump chamber portion is discharged through the second valve and reagent conduit outlet. A pressure reducer is disposed in the main conduit upstream of the downstream point.

In accordance with additional aspects of the present invention, an integrated apparatus is provided for injecting reagent from a reagent supply into a pressurized stream of rinse fluid from a rinse fluid supply. The apparatus comprises a solid housing body with a main bore formed in the housing body, the main bore having an inlet adapted for fluid communication with the rinse fluid supply, and an outlet. A reagent bore is formed in the housing body and has an inlet adapted for fluid communication with the reagent supply and an outlet in fluid communication with a downstream point of the main bore. A first valve is positioned in an upstream portion of the reagent bore and a second valve positioned in a downstream portion of the reagent bore, the first and second valves defining a pump chamber portion of the reagent bore therebetween. A pump bore is formed in the housing body, the pump bore having a large bore section in fluid communication with an upstream point of the main bore and a small bore section in fluid communication with the pump chamber portion of the reagent bore. A unitary piston is disposed in the pump bore, the unitary piston having a large diameter piston head disposed in the large bore section and a small diameter piston head disposed in the small bore section. The unitary piston is biased toward the large bore section to draw reagent through the first valve and into the pump chamber portion of the reagent bore, the pressurized rinse fluid contacting the large diameter piston head to drive the unitary piston toward the small bore section, thereby pushing reagent through the second valve and reagent bore outlet. A pressure reducer is disposed in the main bore between the upstream and downstream points.

In accordance with still further aspects of the present invention, an apparatus is provided for injecting a reagent from a reagent source into pressurized rinse fluid from a rinse fluid source and delivering the rinse fluid and reagent to a vacuum toilet having a bowl. The apparatus comprises a rinse fluid valve having an inlet adapted for fluid communication with the rinse fluid source and an outlet. A main conduit is provided having an inlet in fluid communication with the outlet of the rinse fluid valve, and an outlet. A reagent conduit has an inlet adapted for fluid communication with the reagent source and an outlet in fluid communication with a downstream point of the main conduit. A first valve is positioned in an upstream portion of the reagent conduit and a second valve is positioned in a downstream portion of the reagent conduit, the first and second valves defining a pump chamber portion of the reagent conduit therebetween. A pressure actuated pump has an actuating end in fluid communication with the rinse fluid source and a pumping end in fluid communication with the pump chamber portion. The pressure actuated pump is biased toward a first position in which the reagent is drawn into the pump chamber portion from the reagent source, and is movable to a second position in response to an actuating force generated by the pressurized rinse fluid contacting the actuating end, during which the reagent in the pump chamber portion is discharged through the reagent conduit outlet. A pressure reducer is disposed in the main conduit upstream of the downstream point, and a discharge nozzle is disposed inside the toilet bowl and has an inlet in fluid communication with the outlet of the main conduit.

DETAILED DESCRIPTION OF THE PREFERRED EMBODIMENT

Figure 1:
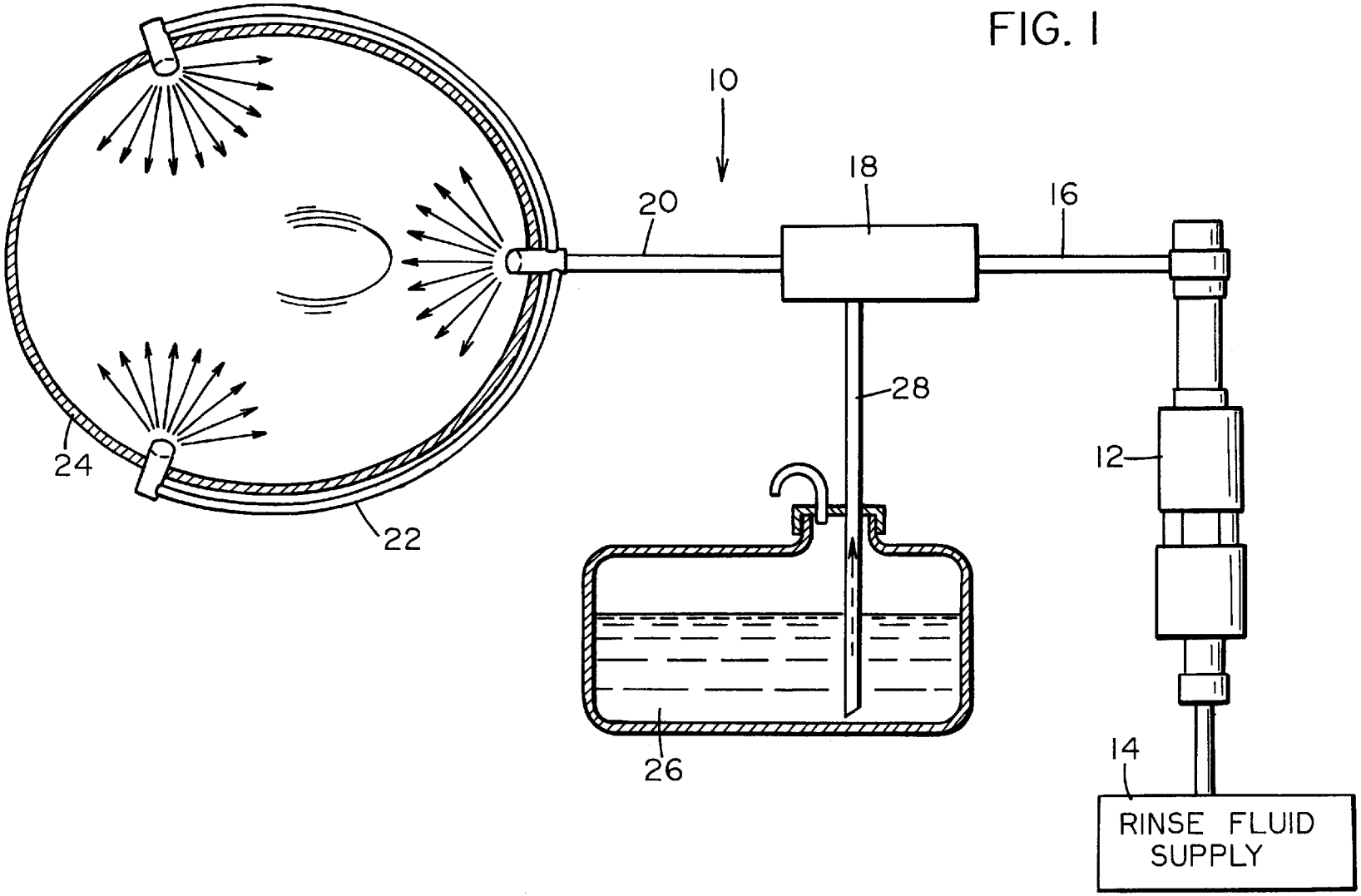
FIG. 1 schematically illustrates a vacuum toilet system embodying certain aspects of the present invention.

A vacuum toilet system 10 incorporating apparatus for injecting a reagent into a stream of pressurized rinse fluid is illustrated in FIG. 1. The illustrated system includes an integrated vacuum breaker and solenoid valve 12 of the kind described in U.S. Pat. No. 4,811,754, the disclosure of which is incorporated by reference herein, having an inlet connected to a supply of pressurized rinse fluid 14. An outlet of the valve 12 is connected by a rinse fluid supply pipe 16 to an integrated device 18 housing a reagent pump 19 for introducing a reagent to the rinse fluid, as described in greater detail below. An outlet of the integrated device 18 is connected by a supply pipe 20 to a spray ring 22 disposed inside the bowl of a vacuum toilet 24. The vacuum toilet system 10 further comprises a reagent source 26 connected by a reagent supply pipe 28 to a reagent inlet of the integrated device 18.

Figure 2:
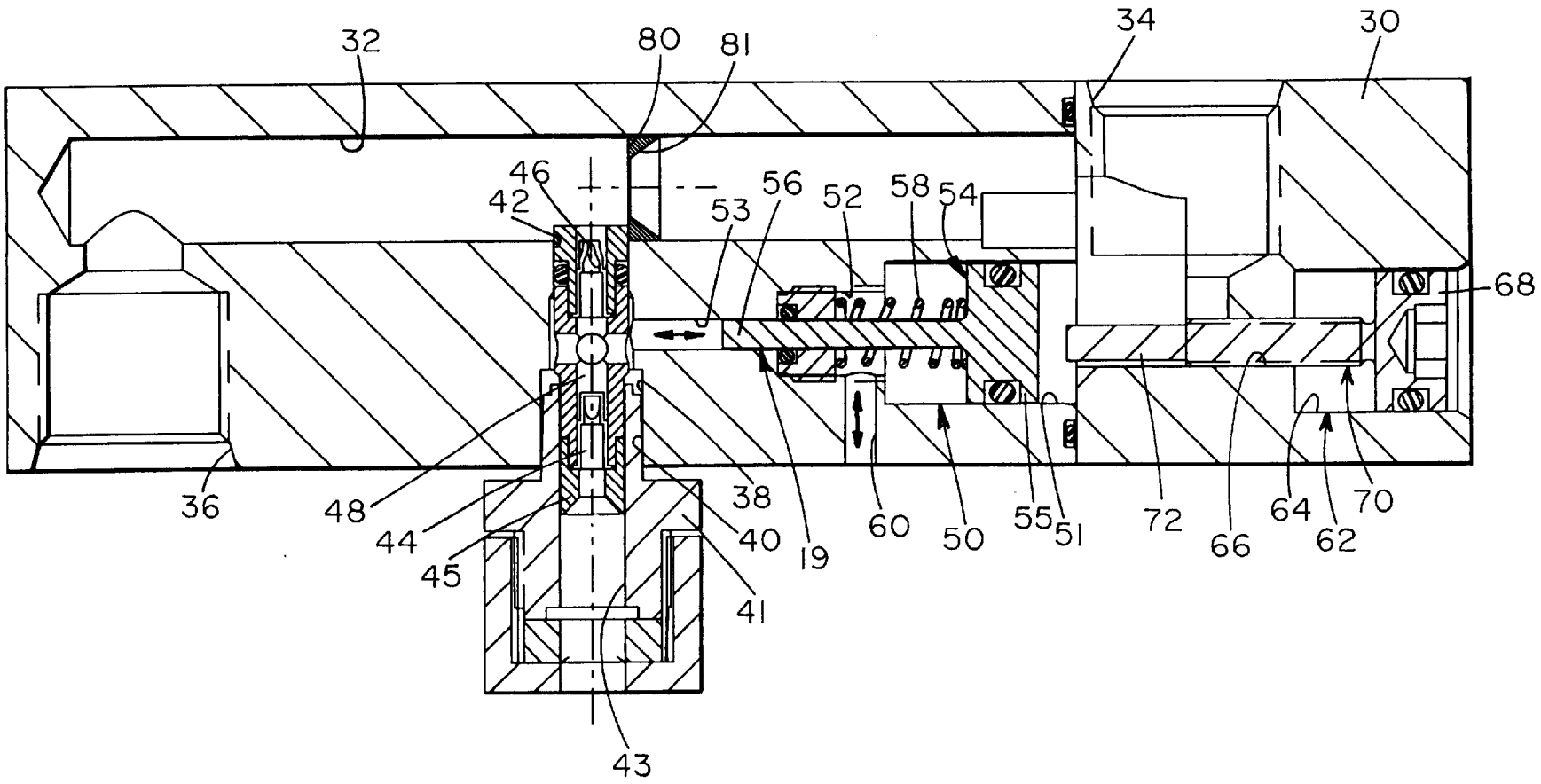
FIG. 2 is an enlarged side elevation view, in cross section, of an integrated device for injecting reagent into a stream of rinse fluid, in accordance with the present invention.

As best shown in FIG. 2, the integrated device 18 comprises a solid housing body 30. A main bore or conduit 32 is formed in the housing body 30 and has an inlet 34 attached to the rinse fluid supply pipe 16 and an outlet 36 attached to the supply pipe 20. The housing body 30 is also formed with a reagent bore 38 defining a reagent inlet 40 connected to the reagent supply pipe 28 and a reagent outlet 42 in fluid communication with the main bore 32.

A first check valve 44 is disposed in an upstream portion of the reagent bore 38 and is oriented to allow fluid to flow into the reagent bore while preventing reverse flow. A second check valve 46 is disposed in a downstream portion of the reagent bore 38 and is oriented to allow flow toward the reagent outlet 42 while preventing a reverse flow. In the preferred embodiment, the first and second check valves 44, 46 are pressure sensitive, Such as duckbill-style check valves, which have a flexible tip acting as the valve member. The flexible tip of each valve expands or contracts according to a pressure differential across the member. In each of the first and second check valves 44, 46, the flexible tip will contract to allow flow when the pressure is greater upstream of the valve. Conversely, the flexible tip will expand to prevent flow when the downstream pressure is greater. A portion of the reagent bore 38 extending between the first and second check valves 44, 46 defines a pump chamber 48 into which reagent is drawn and from which reagent is discharged into the rinse fluid stream.

The housing body 30 is further formed with a pump bore 50. The pump bore 50 has a large diameter bore section 51, an intermediate diameter bore section 52, and a small diameter bore section 53. As shown in FIG. 2, the large bore section 51 fluidly communicates with an upstream point of the main bore 32, while the small bore section 53 fluidly communicates with the pump chamber section 48 of the reagent bore 38. A unitary piston 54 is disposed inside the pump bore 50 and has a large diameter piston head 55 positioned inside the large diameter bore section 51 and a small diameter piston head 56 positioned inside the small diameter bore section 53. The large and small diameter piston heads are suitably sealed with the pump bore 50 to prevent passage of fluid therebetween. A compression spring 58 is disposed inside the pump bore 50 and engages a rear face of the large diameter piston head 55 to bias the unitary piston 54 toward the large bore section 51. An air vent bore 60 extends from the intermediate diameter bore section 52 to an exterior of the housing body 30. The air vent bore 60 allows air to enter into and escape from a section of the pump bore 50 located between the large and small diameter piston heads 55, 56 as the unitary piston 54 actuates.

A coupling 41 is provided for attaching the reagent supply pipe 28 to the reagent inlet 40. As shown in FIG. 2, the coupling 41 preferably has a straight inner bore 43 to minimize flow disturbances as the reagent enters the inlet 40. As best shown in FIG. 2, the inner bore 43 has a diameter which is greater than that of the pump chamber 48. To eliminate a potential area where air bubbles may accumulate, a tapered insert 45 is disposed inside the coupling 41 to gradually decrease the area through which the reagent flows. The tapered insert 45 eliminates a ledge or step that would otherwise tend to accumulate air bubbles, and instead directs air bubbles through the first check valve 44. Furthermore, the pump chamber 48 preferably has a relatively small diameter in comparison to the active portion of the small diameter bore section 53. The active portion is defined herein as the space through which the small diameter piston head 56 travels during a full stroke. By reducing the volume of the pump chamber 48, the unitary piston 54 is more likely to purge any air collected in the pump chamber in a single stroke, thereby ensuring that the pump does not lose its prime.

According to the illustrated embodiment, a stroke adjustment bore 62 is also formed in the housing body 30 and comprises an adjustment section 64 and a pass-through section 66. The adjustment section 64 is preferably threaded to receive the head 68 of an adjustment screw 70. A pin 72 extends from the head 68 and through the pass-through section 66 so that an end of the pin 72 projects into the large diameter bore section 51 of the pump bore 50. Accordingly, it will be appreciated that the pin 72 of the adjustment screw 70 limits the travel of the unitary piston 54 toward the large diameter bore section 51 by providing a stop surface positioned to engage the front face of the large diameter piston head 55. The head 68 of the adjustment screw 70 may be positioned along the threaded adjustment section 62 to vary the position of the stop.

It will be appreciated that the stroke of the unitary piston 54 determines the metered volume or dose delivered by the reagent pump. In a preferred embodiment, the volume of the dose is greater than the volume in the pump chamber 48 to ensure that any air present in the pump chamber is purged with a single stroke of the unitary piston 54. The adjustment screw 70 limits the stroke of the piston 54 and may be repositioned to alter the dose volume. Thus, the active portion of the small diameter bore section 53 is also altered when the adjustment screw 70 is repositioned.

According to certain aspects of the present invention, a pressure reducer is disposed in the main bore 32 upstream of the reagent outlet 42. As best shown in FIG. 2, the pressure reducer comprises an orifice 80 having an inner diameter 81 which is less than the diameter of the main bore 32. As rinse fluid flows through the orifice 80, the reduced diameter 81 produces a pressure drop in the fluid downstream of the orifice 80. As a result, the rinse fluid pressure present at the reagent outlet 42 decreases, thereby reducing the likelihood that the second check valve 46 will collapse. In a preferred embodiment, the shape and size of the orifice 80 has a coefficient of flow of approximately 0.5 to 0.75. In a most preferred embodiment, the orifice 80 is a Borda-style orifice. As will be appreciated from a general understanding, of fluid dynamics, the fluid stream flowing through the orifice 80 develops a smaller cross-sectional area known as the vena contracta. In a preferred embodiment, the orifice 80 is positioned so that the vena contracta is adjacent the reagent outlet 42 so that the pressure drop created by the orifice 80 is greatest in this area.

In operation, the valve 12 temporarily opens in response to flush command to deliver pressurized rinse fluid to the integrated device 18. The rinse fluid enters the main bore 32 and travels through the orifice 80 before existing from the outlet 36. The pressurized rinse fluid contacts the front face of the large diameter piston head 55 to generate an actuating force on the unitary piston 54. The actuating force overcomes the bias force of the spring 58 to drive the unitary piston 54 into the small diameter bore section 53 of the pump bore 50. The large bore section 51 preferably communicates with the main bore 32 upstream of the orifice 80 to utilize the greater pressure level of the rinse flush.

As the unitary piston 54 is pushed into the small bore section 53, fluid present in the active portion of the small diameter bore section 53 is pushed into the pump chamber 48. The pressure inside the pump chamber 48 increases so that the first check valve 44 closes while the second check valve 46 opens to discharge reagent through the outlet 42. Any air bubbles present in the pump chamber 48 are discharged with the reagent due to the relatively large active portion of the small bore section 53.

The mixture of rinse fluid and reagent is delivered to the spray ring 22 where it is discharged into the toilet bowl. When the valve 12 closes to stop the flow of rinse fluid, the spring 58 returns the unitary piston 54 to the initial position. As the unitary piston 54 moves in this direction, it reduces the pressure inside the pump chamber 48 thereby closing the second check valve 46 and opening the first check valve 44. With the first check valve 44 opened, reagent is allowed to flow into the pump chamber until the unitary piston 54 stops moving. With the piston 54 back in the initial position and the pump chamber 48 filled with reagent, the pump 19 is ready for a subsequent rinse operation.

As described above and shown in the drawings, the main bore, reagent bore, and reagent pump are all incorporated into the integrated device 18. The integrated device is compact, light, and may be mounted directly onto a vacuum toilet. While the integrated device is preferred, it will be appreciated that each of the components may be provided separately without departing from the scope of the present invention.

The liquid reagent may comprise one or more components which remove plaque, inhibit the formation of deposits, or provide other benefits in a vacuum toilet environment. This includes all of the components discussed in U.S. Pat. No. 5,692,250 to Oldfelt, which is incorporated herein by reference.

From the above, it will be appreciated that the present invention provides new and improved apparatus for injecting a reagent into a stream of pressurized rinse fluid. The apparatus includes an orifice located in a main conduit upstream of a reagent discharge outlet. The orifice reduces the pressure of the rinse fluid thereby to unload a check valve which controls injection of the reagent into the rinse fluid stream. In addition, the volume of a pump chamber for holding reagent is reduced to ensure that the pump maintains its prime. Furthermore, the piping leading into the pump chamber has a relatively uniform inside surface and a tapered insert is used to reduce the cross-sectional area of the reagent flow stream, thereby directing air bubbles through the pump chamber.

The foregoing detailed description has been given for clearness of understanding only, and no unnecessary limitations should be understood therefrom, as modifications would be obvious to those skilled in the art.

What is claimed is:

1. Apparatus for injecting a reagent from a reagent supply into a stream of pressurized rinse fluid from a rinse fluid supply, the apparatus comprising:

a main conduit having an inlet adapted for fluid communication with the rinse fluid supply and an outlet;

a reagent conduit having an inlet adapted for fluid communication with the reagent supply and an outlet in fluid communication with a downstream point of the main conduit;

a first valve positioned in an upstream portion of the reagent conduit and a second valve positioned in a downstream portion of the reagent conduit, the first and second valves defining a pump chamber portion of the reagent conduit therebetween;

a pressure actuated pump having an actuating end in fluid communication with the rinse fluid supply and a pumping end in fluid communication with the pump chamber portion, the pressure actuated pump being biased toward a first position in which the reagent is drawn through the first valve and into the pump chamber portion from the reagent supply, the pump being movable to a second position in response to an actuating force generated by the pressurized rinse fluid contacting the actuating end, during which the reagent in the pump chamber portion is discharged through the second valve and reagent conduit outlet; and a pressure reducer disposed in the main conduit upstream of the downstream point.

2. The apparatus of claim 1, in which the actuating end of the pressure actuated pump is in fluid communication with an upstream point of the main conduit, and the pressure reducer is positioned between the upstream and downstream points.

3. The apparatus of claim 1, in which the actuating end of the pressure actuated pump comprises a large volume chamber and the pumping end of the pressure actuated pump comprises a small volume chamber, the pressure actuated pump comprising a unitary piston having a large diameter piston head disposed in the large volume chamber and a small diameter piston head disposed in the small volume chamber.

4. The apparatus of claim 3, further comprising a compression spring attached to a back face of the large diameter piston head for biasing the unitary piston toward the first position.

5. The apparatus of claim 1, in which the pressure reducer comprises an orifice.

6. The apparatus of claim 5, in which the orifice has a flow coefficient of between approximately 0.5 and 0.75.

7. The apparatus of claim 1, in which the orifice is positioned immediately upstream of the reagent conduit outlet.

8. The apparatus of claim 1, in which the first and second valves comprise check valves.

9. The apparatus of claim 1, in which the pressure actuated pump displaces a dose volume as the pump moves from the first position to the second position, and the pump chamber has a volume which is smaller than the dose volume.

10. The apparatus of claim 1, further comprising a coupling attached to the reagent conduit inlet, the coupling defining a flow path which is axially aligned with the pump chamber.

11. The apparatus of claim 10, in which the coupling has an inner bore having a first diameter, and in which the pump chamber has a second diameter smaller than the first diameter, the apparatus further comprising a tapered insert disposed inside the coupling having a tapered faced extending from the first diameter to the second diameter.

12. An integrated apparatus for injecting reagent from a reagent supply into a pressurized stream of rinse fluid from a rinse fluid supply, the apparatus comprising:

a solid housing body;

a main bore formed in the housing body, the main bore having an inlet adapted for fluid communication with the rinse fluid supply, and an outlet;

a reagent bore formed in the housing body, the reagent bore having an inlet adapted for fluid communication with the reagent supply and an outlet in fluid communication with a downstream point of the main bore;

a first valve positioned in an upstream portion of the reagent bore and a second valve positioned in a downstream portion of the reagent bore, the first and second valves defining a pump chamber portion of the reagent bore therebetween;

a pump bore formed in the housing body, the pump bore having a large bore section in fluid communication with an upstream point of the main bore and a small bore section in fluid communication with the pump chamber portion of the reagent bore;

a unitary piston disposed in the pump bore, the unitary piston having a large diameter piston head disposed in the large bore section and a small diameter piston head disposed in the small bore section;

wherein the unitary piston is biased toward the large bore section to draw reagent through the first valve and into the pump chamber portion of the reagent bore, the pressurized rinse fluid contacting the large diameter piston head to drive the unitary piston toward the small bore section, thereby pushing reagent through the second valve and reagent bore outlet; and a pressure reducer disposed in the main bore between the upstream and downstream points.

13. The apparatus of claim 12, further comprising a compression spring attached to a back face of the large diameter piston head for biasing the unitary piston toward the large bore section.

14. The apparatus of claim 12, in which the pressure reducer comprises an orifice.

15. The apparatus of claim 12, in which the orifice is positioned immediately upstream of the reagent conduit outlet.

16. The apparatus of claim 12, in which the first and second valves comprise duckbill check valves.

17. The apparatus of claim 12, in which the unitary piston displaces a dose volume as the unitary piston is driven toward the small bore section, and the pump chamber portion of the reagent bore has a volume which is smaller than the dose volume.

18. The apparatus of claim 12, further comprising a coupling attached to the reagent bore inlet, the coupling defining a flow path which is axially aligned with the pump chamber.

19. The apparatus of claim 18, in which the coupling has an inner diameter, and in which the pump chamber has a bore diameter smaller than the inner diameter of the coupling, the apparatus further comprising a tapered insert disposed inside the coupling having a tapered faced extending from the inner diameter to the bore diameter.

20. Apparatus for injecting a reagent from a reagent source into pressurized rinse fluid from a rinse fluid source and delivering the rinse fluid and reagent to a vacuum toilet having a bowl, the apparatus comprising:

a rinse fluid valve having an inlet adapted for fluid communication with the rinse fluid source and an outlet;

a main conduit having an inlet in fluid communication with the outlet of the rinse fluid valve, and an outlet;

a reagent conduit having an inlet adapted for fluid communication with the reagent source and an outlet in fluid communication with a downstream point of the main conduit;

a first valve positioned in an upstream portion of the reagent conduit and a second valve positioned in a downstream portion of the reagent conduit, the first and second valves defining a pump chamber portion of the reagent conduit therebetween;

a pressure actuated pump having an actuating end in fluid communication with the rinse fluid source and a pumping end in fluid communication with the pump chamber portion, the pressure actuated pump being biased toward a first position in which the reagent is drawn into the pump chamber portion from the reagent source, the pump being movable to a second position in response to an actuating force generated by the pressurized rinse fluid contacting the actuating end, during which the reagent in the pump chamber portion is discharged through the reagent conduit outlet;

a pressure reducer disposed in the main conduit upstream of the downstream point; and a discharge nozzle disposed inside the toilet bowl and having an inlet in fluid communication with the outlet of the main conduit.

21. The apparatus of claim 20, in which the actuating end of the pressure actuated pump is in fluid communication with an upstream point of the main conduit, and the pressure reducer is positioned between the upstream and downstream points.

22. The apparatus of claim 20, in which the actuating end of the pressure actuated pump comprises a large volume chamber and the pumping end of the pressure actuated pump comprises a small volume chamber, the pressure actuated pump comprising a unitary piston having a large diameter piston head disposed in the large volume chamber and a small diameter piston head disposed in the small volume chamber.

23. The apparatus of claim 22, in which the pressure reducer comprises an orifice.

24. The apparatus of claim 23, in which the orifice has a flow coefficient of between approximately 0.5 and 0.75.

25. The apparatus of claim 20, in which the orifice is positioned immediately upstream of the reagent conduit outlet.

26. The apparatus of claim 20, in which the discharge nozzle comprises a spray ring.

27. The apparatus of claim 20, in which the pressure actuated pump displaces a dose volume as the pump moves from the first position to the second position, and the pump chamber has a volume which is smaller than the dose volume.

28. The apparatus of claim 20, further comprising a coupling attached to the reagent conduit inlet, the coupling defining a flow path which is axially aligned with the pump chamber.

29. The apparatus of claim 28, in which the coupling has an inner bore having a first diameter, and in which the pump chamber has a second diameter smaller than the first diameter, the apparatus further comprising a tapered insert disposed inside the coupling having a tapered faced extending from the first diameter to the second diameter.

* * * * *